United States Patent [19]

Martin

[11] Patent Number: 4,672,947

[45] Date of Patent: Jun. 16, 1987

[54] GRATE BAR FOR USE IN INDUSTRIAL FURNACES

[76] Inventor: Johannes J. E. Martin, St. Heinricher Str. 55, D-8124 Seeshaupt, Fed. Rep. of Germany

[21] Appl. No.: 763,880

[22] Filed: Aug. 8, 1985

Related U.S. Application Data

[63] Continuation of Ser. No. 524,031, Aug. 17, 1983, abandoned.

[30] Foreign Application Priority Data

Aug. 17, 1982 [DE] Fed. Rep. of Germany ..... 3230597

[51] Int. Cl.[4] ..... F23H 11/00

[52] U.S. Cl. ..... 126/163 R; 110/281; 110/298; 126/167; 432/239

[58] Field of Search ..... 432/77, 83, 173, 239; 110/298, 281, 302; 126/163, 167

[56] References Cited

U.S. PATENT DOCUMENTS

| | | | |
|---|---|---|---|
| 1,481,366 | 1/1924 | Herkenrath | 126/167 |
| 2,257,287 | 9/1941 | Thorsell | 126/167 |
| 2,745,364 | 5/1956 | Martin | 110/298 |
| 3,508,535 | 4/1970 | Martin et al. | 110/298 |
| 4,314,541 | 2/1982 | Martin et al. | 126/163 R |

FOREIGN PATENT DOCUMENTS 2806974 6/1979 Fed. Rep. of Germany .

*Primary Examiner*—Henry C. Yuen

*Attorney, Agent, or Firm*—L. Lawton Rogers, III; Joseph M. Killeen

[57] ABSTRACT

A grate bar has an elongated top wall, two longitudinally extending sidewalls, transversely extending front and rear walls, a bottom wall, and several longitudinally extending ribs at the underside of the top wall. The walls define an air heating chamber which receives fresh air from a first opening below the rar wall and discharges heated air by way of a second opening which is provided in one of the sidewalls close to the front wall. The ribs divide the chamber into several elongated channels and a compartment which is located immediately behind the front wall and communicates with the channels as well as with the second opening. At least one of the ribs which are nearest to the one sidewall is spaced apart from the bottom wall so that the channels which flank such rib can communicate with one another along the upper side of the bottom wall. Any solid particles which descend onto the bottom wall by entering the chamber via the second opening are free to travel rearwardly and to leave the channels by way of the first opening. Such evacuation can be promoted by providing some of the ribs with apertures which allow for communication between neighboring channels and/or by inclining the foremost portion of the bottom wall downwardly and rearwardly so that such foremost portion and the adjacent portion of the bottom wall define an additional opening and the foremost portion constitutes a chute for evacuation of solid particles by way of the additional opening.

23 Claims, 6 Drawing Figures

GRATE BAR FOR USE IN INDUSTRIAL FURNACES

This application is a continuation of application Ser. No. 524,031, filed Aug. 17, 1983, now abandoned.

BACKGROUND OF THE INVENTION

The present invention relates to grates for furnaces, especially for industrial furnaces, and more particularly to improvements in grate bars for use in composite grates of such furnaces.

It is already known to assemble the grate of an industrial furnace from discrete grate bars which are supported by a frame and serve to support solid fuel while permitting streams of preheated air to penetrate therebetween and to rise into contact with the fuel. Reference may be had to German Pat. No. 28 06 974. This patent discloses grate bars of the type wherein a longitudinally extending top wall is integrally connected with downwardly extending longitudinal sidewalls, a front wall and a rear wall. The grate bars which are disclosed in the German patent further comprise a bottom wall which is spaced apart from the top wall and defines with the remaining walls an air heating chamber wherein the inflowing fresh air is preheated preparatory to admission into the combustion chamber of the furnace. The underside of the top wall is provided with downwardly extending cooling ribs which divide the air heating chamber into longitudinally extending channels wherein fresh air can flow from a first opening at the rear wall toward a second opening in one of the sidewalls close to the front wall. It is also known to provide in front of the ribs a compartment which receives fresh air from the channels and communicates with the second opening in the one sidewall.

The grate bar which is disclosed in the German patent has a small number of ribs so that such ribs define rather wide channels for the flow of fresh air from the first opening toward the compartment behind the front wall. This is considered desirable and advantageous because any solid particles which descend from the combustion chamber and enter the compartment by way of the second opening can readily leave the air heating chamber by advancing along the bottom wall rearwardly toward and by leaving the grate bar by way of the first opening. When the grate bar is installed in the furnace, the bottom wall slopes rearwardly and downwardly so that any solid particles which enter the air heating chamber exhibit a tendency to advance along the downwardly sloping upper side of the bottom wall and to leave the grate bar via the first opening. However, the air heating action of such grate bars is rather limited in view of the relatively small number of cooling ribs in the air heating chamber, i.e., the exchange of heat between the inflowing fresh air and the ribs is not very pronounced so that the temperature of air leaving the grate bar via the second opening is too low. Moreover, the relatively small number of ribs cannot ensure adequate cooling of the grate bar. On the other hand, the number of ribs in such conventional grate bars cannot be increased at will because this results in undue narrowing of the channels and renders it likely that the channels become clogged with solid particles to thus prevent the admission of requisite quantities of fresh air and adequate cooling of the grate bar.

OBJECTS AND SUMMARY OF THE INVENTION

An object of the invention is to provide a novel and improved grate bar which is constructed and assembled in such a way that it allows large quantities of air to pass therethrough and at the same time greatly reduces the likelihood of clogging of the air heating chamber with impurities which enter such chamber by way of the air evacuating opening.

Another object of the invention is to provide a grate bar which can be provided with a large number of cooling ribs to thus enhance not only the air heating action but also the cooling action upon the walls while simultaneously preventing the accumulation of solid matter in its air heating chamber.

A further object of the invention is to provide a grate bar wherein the cooling ribs at the underside of the top wall are distributed and configurated in a novel and improved way.

An additional object of the invention is to provide a grate bar which can be used in existing industrial furnaces as a superior substitute for heretofore known grate bars.

Another object of the invention is to provide a novel and improved method of enhancing the air heating action of grate bars without rendering such grate bars prone to clogging with solid matter such as cinder, ashes, particles of uncombusted fuel and the like.

A further object of the invention is to provide a grate bar whose manufacturing cost is no higher than that of heretofore known grate bars.

Another object of the invention is to provide a grate bar which provides several outlets for evacuation of solid matter from the air heating chamber.

The invention is embodied in a grate bar which is particularly suited for use in composite grates of industrial furnaces and comprises an elongated top wall, a front wall extending substantially transversely of and downwardly from one end of the top wall, a rear wall extending substantially transversely of and downwardly from a region at the other end (or close to the other end) of the top wall, a pair of elongated sidewalls extending longitudinally of and downwardly from the top wall, at least between the front and rear walls (but preferably beyond the rear wall, the same as the top wall), and a bottom wall which is spaced apart from the top wall and defines with the top, front, rear and sidewalls an air heating chamber. The grate bar has at least one first opening which is disposed in the region of the rear wall and serves to admit fresh air into the chamber and a second opening provided in one of the sidewalls close to the front wall and serving for evacuation of heated air from the chamber. The grate bar further comprises a plurality (e.g., at least five) cooling ribs which extend from the top wall downwardly into the chamber to exchange heat with air flowing from the first toward the second opening. The ribs divide the chamber into a plurality of channels which extend substantially longitudinally of the top wall and a compartment which is adjacent to the front wall and communicates with the front ends of the channels as well as with the second opening. In accordance with a feature of the invention, the ribs include a first rib which is nearest to the one sidewall and is spaced apart from the bottom wall so that any solid matter which enters the compartment by way of the second opening can readily enter the channels at both sides of the first rib to advance rearwardly and to leave the grate bar by way of the first opening or openings.

The ribs can include a first group of several ribs which are nearer to the one sidewall and a second group of two or more ribs which are nearer to the other sidewall. The ribs of the first group are more distant from the front wall than the ribs of the second group, i.e., the compartment is longer in front of the first group of ribs than in front of the second group of ribs. This also contributes to more reliable evacuation of solid matter from the compartment toward and through the first opening.

At least some of the ribs are preferably provided with apertures which allow the air to flow between the neighboring channels. This contributes to more pronounced agitation of inflowing air and to more pronounced exchange of heat between the ribs and the streams of air. Each apertured rib (or at least some of the apertured ribs) can include a plurality of elongated sections at least some of which are inclined with reference to the longitudinal direction of the top wall. The inclination of such inclined sections need not be the same; different inclinations of these sections contribute to turbulent flow of air from the first toward the second opening and hence to more satisfactory exchange of heat with the ribs. Certain apertured ribs can consist of or include substantially post- or stud-shaped sections.

One of the ribs is preferably disposed substantially midway between the two sidewalls and such median rib is preferably devoid of apertures so that the channels between such median rib and the other sidewall communicate with the remaining channels only by way of the compartment behind the front wall.

The front portion of the bottom wall and the portion behind it can define an additional opening for admission of air into the chamber and for direct evacuation of solid particles from the compartment. To this end, the front portion preferably slopes downwardly and rearwardly so that it constitutes a chute along which the solid particles can roll or slide toward and into the additional opening. The rear portion or portions of the bottom wall are nearer to the ribs than the front portion.

The height of the sidewalls (which can be said to constitute two additional ribs, namely, the two outermost ribs) preferably exceeds the height of the ribs in the aforementioned chamber. Also, the width of at least some of the channels can increase in a direction toward the rear wall; this can be achieved by providing the top wall with ribs whose thickness increases in a direction from the rear wall toward the front wall.

The top wall and the sidewalls can extend rearwardly beyond the rear wall, and the first opening can be disposed below the rear wall, i.e., between the upper side of the bottom wall and the lower edge face of the rear wall. This means that the height of the rear wall is or can be less than the height of the ribs.

The one sidewall includes an inwardly extending front portion which defines the second opening and is adjacent to the front wall. The bottom wall has a portion which extends outwardly beyond the front portion of the one sidewall and serves to intercept at least some solid particles which descend in the furnace from the combustion chamber along the outer side of the front portion of the one sidewall. The bottom wall can constitute a relatively thin plate and is preferably a discrete component resting on ledges provided therefor at the inner sides of the sidewalls.

The thickness of at least some cooling ribs preferably decreases in a direction from the top wall toward the bottom wall, and each such rib preferably extends all the way to the rear wall but short of the front wall.

The novel features which are considered as characteristic of the invention are set forth in particular in the appended claims. The improved grate bar itself, however, both as to its construction and the mode of installing the same, together with additional features and advantages thereof, will be best understood upon perusal of the following detailed description of certain specific embodiments with reference to the accompanying drawing.

DESCRIPTION OF THE PREFERRED EMBODIMENTS

Figure 1:
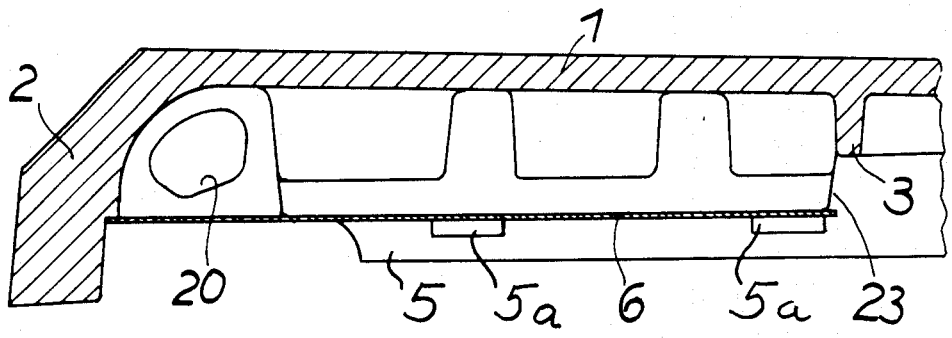
FIG. 1 is a fragmentary longitudinal sectional view of a grate bar which embodies one form of the invention, the section being taken in the direction of arrows as seen from the line I—I of FIG. 2.
Figure 2:
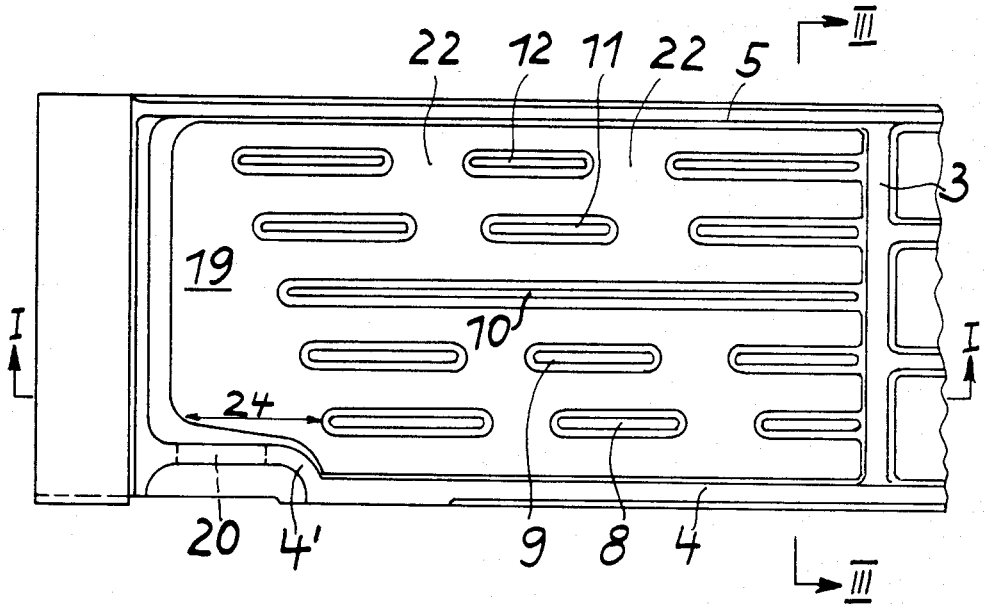
FIG. 2 is a bottom plan view of the grate bar, with the bottom wall removed.
Figure 3:
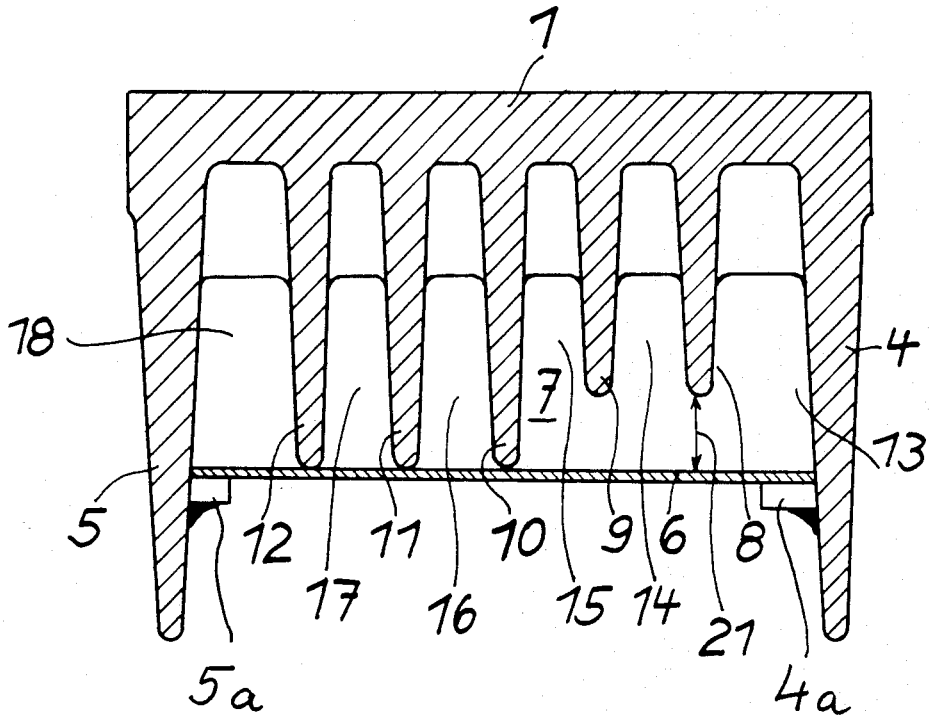
FIG. 3 is a transverse vertical sectional view as seen in the direction of arrows from the line III—III of FIG. 2.

The grate bar of FIGS. 1 to 3 comprises an elongated top wall which is integral with a transversely and downwardly extending front wall 2 and a transversely and downwardly extending rear wall 3. The front wall 2 extends downwardly from the front end of the top wall 1, and the rear wall 3 extends downwardly from a portion of the top wall 1 which is spaced apart from the rear end (not shown) of the top wall. The latter is further integral with two longitudinally extending sidewalls 4 and 5 which extend downwardly beyond the rear wall 3. A relatively thin plate-like bottom wall 6 rests on ledges 4*a*, 5*a* which are provided at the inner sides of the sidewalls 4 and 5 (see FIG. 3) and the bottom wall defines with the walls 1, 2, 3, 4 and 5 an elongated air heating chamber 7. The top wall 1 is formed with five elongated ribs 8, 9, 10, 11 and 12 which extend in substantial parallelism with the sidewalls 4, 5 and subdivide the chamber 7 into six elongated channels 13, 14, 15, 16,17 and 18. The rear ends of the ribs 8 to 12 are integral with the rear wall 3 and the front ends of such ribs terminate short of the front wall 2 so that the front portion of the chamber 7 constitutes a compartment 19 extending all the way between the sidewalls 4, 5 immediately adjacent to the front wall 2. The height of the rear wall 3 is less than that of the ribs 8 to 12; and this rear wall defines with the rear portion of the bottom wall 6 a first opening 23 which extends all the way between the sidewalls 4, 5 and serves for admission of fresh air into the chamber 7, i.e., into the rear end portions of the channels 13 to 18. The front portion 4' of the sidewall 4 has an opening 20 which communicates with the compartment 19 and serves for evacuation of heated air from the chamber 7 and for admission of such air into the combustion chamber of the furnace. The stream of heated air which issues from the chamber 7 via opening 20 flows through a narrow gap between two neighboring grate bars to enter the combustion chamber from below. Thus, the grate bar is heated by burning fuel which rests on top of the wall 1, the inflowing fresh air removes heat from the heated grate bar, and the thus heated air is admitted into the combustion chamber to effect oxidation of the fuel.

As can be seen in FIG. 2, the front portion 4' of the sidewall extends inwardly (toward the sidewall 5) and is located immediately behind the respective portion of the front wall 2. On the other hand, a portion of the front part of the bottom wall 6 extends laterally outwardly beyond the front portion 4' so that the outwardly extending portion of the bottom wall 6 can intercept solid particles which happen to descend between the illustrated grate bar and the neighboring grate bar. The solid particles descend from the combustion chamber through the relatively narrow clearance between the illustrated grate bar and the neighboring grate bar and find their way into the compartment 19 by way of the opening 20. The particles which enter the compartment 19 thereupon enter the front portions of the channels 13 to 18 and begin to advance rearwardly and ultimately leave the grate bar via opening 23. To this end, the bottom wall 6 slopes rearwardly and downwardly in a direction from the front wall 2 toward the opening 23 below the rear wall 3. The channels 13, 14 and 15 which are nearer to the opening 20 in the sidewall 4 are more likely to receive the major percentage of solid particles than the more distant channels 16, 17 and 18. In order to enhance such tendency of solid particles to enter the channels 13 to 15, rather than the more distant channels 16 to 18, the ribs 8 and 9 are shorter than the ribs 10, 11 and 12 (note FIG. 3) so that the ribs 8, 9 and the adjacent portions of the bottom wall 6 define passages whose height is shown at 21. Thus, solid particles which enter the compartment 19 via opening 20 are actually free to enter any one of the six channels 13 to 18 but are much more likely to enter the nearest channels 13, 14 and 15. Moreover, the particles in the channel 13, 14 or 15 can readily move sideways to enter the channel 14 from the channel 13 or 15, or to enter the channels 13, 15 from the channel 14. The likelihood that the solid particles will enter the channels 13, 14 and 15, rather than the channels 16, 17 and 18, is further enhanced by selecting the length of the ribs 8 to 12 in such a way that the ribs which are nearer to the sidewall 4 and its opening 20 are shorter than the ribs which are more distant from this sidewall. This can be seen in FIG. 2 wherein the character 24 denotes the distance between the front wall and the rib 8; such distance exceeds the distance between the front wall 2 and the rib 9, the latter distance, in turn, exceeds the distance between the front wall 2 and the rib 10, and so forth. Thus, it can be said that the ribs 8-12 form a first group which is nearer to the sidewall 4 and whose ribs are more distant from the front wall 2, and a second group of ribs which are more distant from the sidewall 4 but are nearer to the front wall.

The shortening of those ribs which are nearer to the sidewall 4 enhances the likelihood that at least the major particles of solid matter will enter the adjacent channel 13, 14 or 15 and the provision of passages below the ribs 8 and 9 reduces the likelihood of clogging of the channels 13, 14 and 15 (which are most likely to receive larger solid particles) because the larger particles can slide sideways during movement along the upper side of the bottom wall 6 to leave a filled or nearly filled channel (e.g., 13 or 14) and to enter the less filled neighboring channel (14 or 15).

The ribs 8, 9, 11 and 12 are formed with apertures 22 which permit free flow of air between the respective channels, namely, between the channels which flank the apertured ribs. The median rib 10 is devoid of apertures 22 and thus constitutes a partition or barrier which prevents solid particles from leaving the channels 13 to 15 and entering the channels 16 to 18, i.e., the channels 16 to 18 can receive only those solid particles which leave the compartment 19 and enter the front ends of such channels. It has been found that the aforementioned features (the absence of apertures 22 in the median rib 10, the lengthening of ribs 10 to 12 toward the front wall 2, as compared with the ribs 8 and 9, and the remoteness of channels 16 to 18 from the opening 20) greatly reduce the likelihood of penetration of appreciable quantities of solid matter into the channels 16 to 18. On the other hand, the ribs 10, 11 and 12 can readily exchange heat with the inflowing fresh air to ensure adequate cooling of the entire top wall 1. As a rule, the major percentage of solid particles will leave the grate bar by way of the channels 13, 14 and 15, i.e., the channels 16 to 18 are likely to receive solid particles only if the channels 13 to 15 are more or less clogged. This ensures that at least one-half of the grate bar is adequately cooled in the event of clogging of one or more channels which are nearest to the opening 20. The provision of apertures 22 in the ribs 8, 9, 11 and 12 greatly reduces the likelihood of clogging of these channels and enhances the exchange of heat between the inflowing air and the ribs.

That portion of the grate bar which is located behind the rear wall 3 is not channeled because it is shielded from heat in the combustion chamber by the front portion of the grate bar therebehind. Such front portion of the next-following grate bar overlies the rear portion of the illustrated grate bar.

An important advantage of the improved grate bar is that the likelihood of clogging of its channels is very remote or practically non-existent. This is due to the fact that the channels (such as 13 and 14) which are nearest to the opening 20 (which admits solid matter) are free to communicate with one another by way of the respective passage above the upper side of the bottom wall 6. Such reduction of likelihood of clogging of the channels in the region of the sidewall 4 is achieved by the simple expedient of shortening the ribs 8 and 9, as considered in a direction from the top wall 1 toward the bottom wall 6. The height of the passage between the upper side of the bottom wall 6 and the lower edge face of the rib 8 or 9 can exceed the width of the channel 13, 14, 15, 16, 17 or 18 to thus ensure that a solid particle which would be stuck in the upper portion of the channel 13, 14 or 15 is free to advance in the passage below rib 8 or 9 on its way toward and through the opening 23 below the rear wall 3. As can be seen in FIG. 3, the width of one or more channels can exceed the width of the remaining channel or channels. In this embodiment, the width of the two outermost channels 13 and 18 is greater than the width of the channel 14, 15, 16 or 17. The number of ribs can greatly exceed the number of ribs in the chamber of a conventional grate bar having the same dimensions so that the improved grate bar is subject to more intensive cooling and transmits larger quantities of heat to the inflowing fresh air. The number of ribs can be greatly increased across the full width of the grate bar or, at the very least, in the region adjacent to the sidewall (4) which has the air evacuating opening 20 (namely, the opening which admits solid particles into the compartment 19). The number of ribs can be increased without incurring the risk of rapidly clogging the channels because the passages below the ribs 8 and 9, as well as the apertures 22 between the sections of the ribs 8, 9, 11 and 12, greatly reduce the likelihood of clogging of the channels 13 to 18 with fragments of uncombusted fuel, ashes, cinder and like solid material. The likelihood of clogging of the channels is further reduced by the aforediscussed feature that the ribs which are nearer to the sidewall 4 are more distant from the front wall 2 than the remaining ribs, i.e., that the length of the compartment 19 (as considered in the longitudinal direction of the top wall 1) is smaller in the region of the sidewall 5 than in the region of the sidewall 4. This causes the major particles of solid matter to enter the channels (13, 14 and 15) which are nearer to the opening 20 so that the likelihood of clogging of the channels 16, 17 and 18 is especially remote. This ensures at least partial cooling of the improved grate bar, even in the unlikely event that the channels 13, 14 and 15 are filled with solid matter and are thus incapable of permitting appreciable quantities of fresh air to flow therethrough. The exchange of heat between air and the taller ribs 10, 11 and 12 is somewhat more pronounced than that between the ribs 8, 9 and the inflowing air. On the other hand, the ribs 8 and 9 allow larger quantities of air to flow from the opening 23 toward the compartment 19.

As mentioned above, the likelihood of clogging of the channels is reduced due to the fact that the ribs 8, 9, 11 and 12 consist of elongated sections with apertures 22 therebetween. This enables solid particles to migrate sideways from channel to channel thereby reducing the likelihood of complete filling of the channels and interference with the flow of requisite quantities of fresh air toward the compartment 19.

Figure 4:
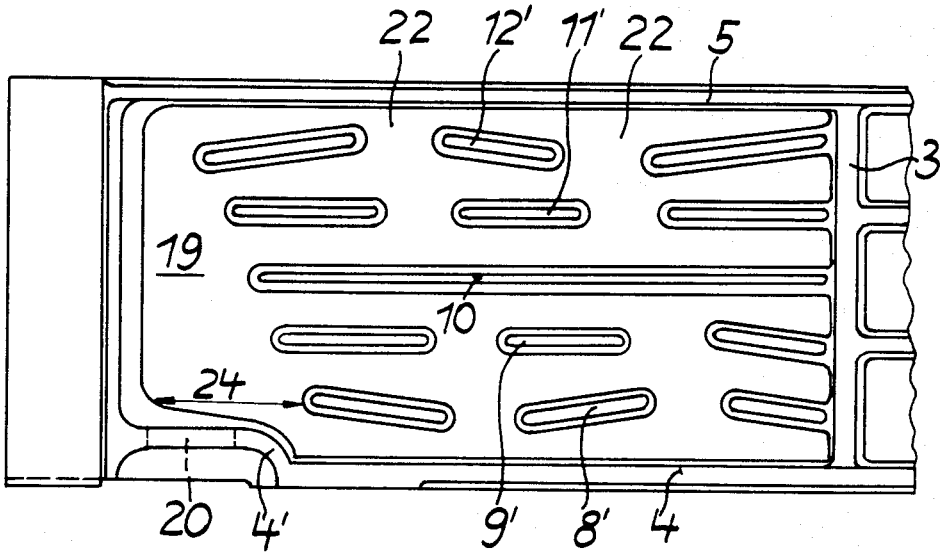
FIG. 4 is a fragmentary bottom plan view of a modified grate bar, with the bottom wall removed.

FIG. 4 illustrates a portion of a second grate bar which differs from the grate bar of FIGS. 1 to 3 in that the sections 8', 9', 11' and 12' of the apertured ribs are inclined with respect to the longitudinal direction of the top wall (i.e., with respect to the sidewalls 4 and 5) and that some of these sections are also inclined with reference to each other. Thus, all of the sections 8' are inclined with reference to each other, the same as all of the sections 12'. On the other hand, two of the three sections 9' are parallel to each other and the rearmost section 9' is somewhat inclined with reference to the two preceding sections 9'. The just described distribution of sections of certain ribs creates turbulence in the stream of fresh air entering the channels in the region of the rear wall 3. Such turbulence, in turn, enhances the exchange of heat between the inflowing air and the ribs.

The mutually inclined sections of certain ribs further promote lateral movement of solid particles between neighboring channels and thereby further reduce the likelihood of clogging.

Figure 5:
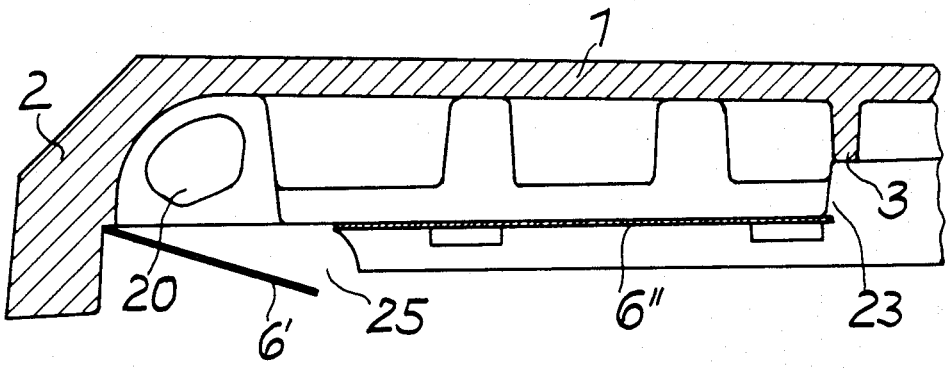
FIG. 5 is a fragmentary longitudinal vertical sectional view of a third grate bar wherein the front portion of the bottom wall constitutes a chute.

FIG. 5 illustrates a portion of a grate bar which is similar to or identical with the grate bar of FIGS. 1 to 3 or FIG. 4 except that the bottom wall includes a discrete front portion 6' and a discrete rear portion 6''. The front portion 6' slopes downwardly and rearwardly from the front wall 2 toward the rear wall 3 and thus constitutes a chute which causes solid particles to leave the chamber (and more particularly the compartment constituting the front portion of the chamber) by way of an additional opening 25 between the rear edge of the front portion 6' and the front edge of the rear portion 6'' of the composite bottom wall. The opening 25 discharges a substantial or even major percentage of solid matter which enters the interior of the grate bar via opening 20.

The provision of a two-piece or composite bottom wall, which defines an additional opening, is desirable and advantageous when the quantity of solid particles entering via opening 20 is very large. Though the opening 25 reduces the rate of flow of fresh air from the rear wall 3 toward the compartment behind the front wall 2 of the grate bar which is shown in FIG. 5, such additional opening greatly reduces the quantity of solid matter which is likely to enter the channels and hence greatly reduces the likelihood of clogging of these channels.

Figure 6:
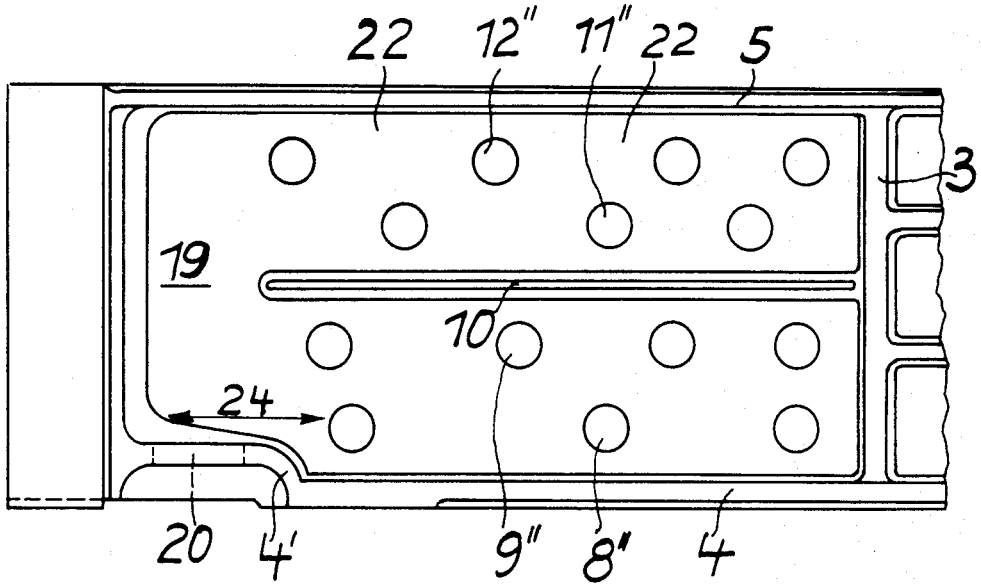
FIG. 6 is a fragmentary bottom plan view of a fourth grate bar, with the bottom wall removed.

FIG. 6 shows a portion of a fourth grate bar wherein the sections 8'', 9'' 11'' and 12'' of the respective ribs are elongated studs or posts extending downwardly from the underside of the top wall 1. Thus, the apertures 22 are much wider than in the embodiments of FIGS. 1–3, 4 and 5 so that the likelihood of clogging of the channels between the ribs is even more remote. The studs 8'', 9'', 11'' and/or 12'' may but need not have a circular cross-sectional outline. For example, such studs can have an oval or a polygonal outline without departing from the spirit of the invention. The studs promote turbulence in the channels 22 and thus enhance the exchange of heat between the inflowing air and the grate bar.

The feature that the median rib 10 is devoid of apertures further reduces the likelihood of clogging of the channels, even if the quantity of incoming solid matter is greater than anticipated and even if such solid matter contains certain larger particles. Thus, the non-matter apertured median rib shields the channels 16, 17 and 18 from entry of solid matter directly from the channel 15. In other words, the channels 16 to 18 receive solid matter (if any) solely from the respective portions of the compartment 19 but not from the remaining channels (namely, from the channels which are nearer to the sidewall 4 and its opening 20).

The height of the sidewalls 4, 5 (i.e., of the two outermost ribs) exceeds the height of the ribs in the air heating chamber. This enhances the exchange of heat between the inflowing air and the grate bar because the bottom wall can be placed closer to the underside of the top wall with the result that the cross-sectional areas of the channels are reduced with attendant higher velocity of inflowing fresh air.

The exchange of heat between fresh air and the grate bar can be enhanced still further by causing the channels to diverge in a direction from the front wall toward the rear wall, i.e., the ribs can constitute flow restrictors which obstruct the flow of fresh air toward the compartment at a gradually increasing rate. Such divergence of the channels can be achieved by the simple expedient of providing ribs whose width increases gradually in a direction from the rear wall 3 toward the front wall 1. Moreover, gradual widening of the channels further reduces the likelihood of clogging because, once a solid particle has managed to enter the narrowest (front) portion of a channel, it is highly unlikely to become stuck in the remaining portion of the respective channel since the width of such remaining portion then increases gradually all the way to the opening 23 below the rear wall 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contributions to the art and, therefore, such adaptations should and are intended to be comprehended within the meaning and range of equivalence of the appended claims.

I claim:

1. A grate bar, particularly for use in the grates of industrial furnaces, comprising an elongated top wall; a front wall extending substantially transversely of and downwardly from the region of one end of said top wall; a rear wall extending substantially transversely of and downwardly from the region of the other end of said top wall; a pair of elongated sidewalls extending longitudinally of and downwardly from said top wall, at least between said front and rear walls; a bottom wall spaced apart from said top wall and defining therewith, as well as with said sidewalls and said front and rear walls, an air heating chamber, said grate bar having at least one first opening in the region of said rear wall for admission of fresh air into, and one of said sidewalls having a second opening in the region of said front wall for evacuation of air from, said chamber; and a plurality of cooling ribs extending from said top wall downwardly into said chamber to exchange heat with air flowing from said first toward said second opening, said ribs dividing said chamber into a plurality of channels extending substantially longitudinally of said top wall, and a compartment adjacent to said front wall and communicating with said channels as well as with said second opening, said ribs including a first rib which is nearest to said one sidewall and is spaced apart from said bottom wall by a distance sufficient to provide room for migration of solid particles.

2. The grate bar of claim 1, wherein said ribs include a first group of at least two ribs nearer to said one sidewall and including said first rib, and a second group of at least two ribs nearer to the other of said sidewalls, the ribs of said first group being more distant from said front wall than the ribs of said second group.

3. The grate bar of claim 1, wherein at least some of said ribs have apertures which establish paths for the flow of air and for migration of solid particles between neighboring channels.

4. The grate bar of claim 3, wherein each of said apertured ribs includes a plurality of sections, and at least some of said sections are inclined with reference to the longitudinal direction of said top wall.

5. The grate bar of claim 4, wherein said inclined sections have different inclinations with reference to the longitudinal direction of said top wall.

6. The grate bar of claim 3, wherein said apertured ribs include substantially stud-shaped sections.

7. The grate bar of claim 3, wherein said ribs include a median rib which is disposed substantially midway between said sidewalls and is devoid of apertures.

8. The grate bar of claim 1, wherein said bottom wall includes a front portion nearer to and a rear portion more distant from said front wall, said front and rear portions defining an additional opening for admission of air into said chamber.

9. The grate bar of claim 8, wherein the rear portion of said bottom wall is nearer to said ribs than said front portion.

10. The grate bar of claim 8, wherein the front portion of said bottom wall slopes downwardly and away from said top wall in a direction from said front wall toward said rear wall so as to constitute a chute for evacuation of solid particles from said compartment by way of said additional opening.

11. The grate bar of claim 1, wherein the height of said sidewalls exceeds the height of said ribs.

12. The grate bar of claim 1, wherein the width of at least some of said channels increases in a direction from said compartment toward said rear wall.

13. The grate bar of claim 1, wherein the thickness of said ribs increases in a direction from said rear wall toward said front wall.

14. The grate bar of claim 1, wherein said top wall and said sidewalls extend rearwardly beyond said rear wall.

15. The grate bar of claim 1, wherein the height of said rear wall is less than the height of said ribs and said sidewalls, said rear wall being disposed above said first opening.

16. The grate bar of claim 1, wherein said one sidewall has an inwardly extending front portion which is adjacent to said front wall and defines said second opening, said bottom wall having a portion extending laterally outwardly of said front portion so as to intercept at least some solid particles which happen to descend in the furnace along the outer side of the front portion of said one sidewall.

17. The grate bar of claim 1, wherein said bottom wall is a relatively thin plate.

18. The grate bar of claim 17, wherein said sidewalls have inner sides, and ledges provided at said inner sides to support at least a portion of said bottom wall.

19. The grate bar of claim 1, wherein the thickness of at least some of said ribs decreases in a direction from the top wall toward the bottom wall.

20. The grate bar of claim 1, wherein each of said ribs extends all the way to said rear wall, and each of said ribs is spaced apart from said front wall.

21. The grate bar of claim 1, wherein said ribs comprise a first group of at least two ribs nearer to said one sidewall and including said first rib, and a second group of at least two ribs nearer to the other of said sidewalls, the ribs of said first group being spaced from said bottom wall, and the ribs of said second group contacting said bottom wall.

22. A grate bar, particularly for use in the grates of industrial furnaces, comprising an elongated top wall; a front wall extending substantially transversely of and downwardly from the region of one end of said top wall; a rear wall extending substantially transversely of and downwardly from the region of the other end of said top wall; a pair of elongated sidewalls extending longitudinally of and downwardly from said top wall, at least between said front and rear walls; a bottom wall spaced apart from said top wall and defining therewith, as well as with said sidewalls and said front and rear walls, an air heating chamber, said grate bar having at least one first opening in the region of said rear wall for admission of fresh air into, and one of said sidewalls having a second opening in the region of said front wall for evacuation of air from, said chamber, said one sidewall having an inwardly extending front portion which is adjacent to said front wall and defines said second opening, said bottom wall having a portion extending laterally outwardly of said front portion so as to intercept at least some solid particles which happen to descend in the furnace along the outer side of the front portion of said one sidewall, said bottom wall including a front portion nearer to and a rear portion more distant from said front wall, said front and rear portions of said bottom wall defining an additional opening; and a plurality of cooling ribs extending from said top wall downwardly into said chamber to exchange heat with air flowing from said first toward said second opening, said ribs dividing said chamber into a plurality of channels extending substantially longitudinally of said top wall, and a compartment adjacent to said front wall and communicating with said channels as well as with said second opening, said ribs including a first rib which is nearest to said one sidewall and is spaced apart from said bottom wall, said ribs further including a first group of at least two ribs nearer to said one sidewall and including said first rib, and a second group of at least two ribs nearer to the other of said sidewalls, the ribs of said first group being more distant from said front wall than the ribs of said second group, at least some of said ribs having apertures which establish paths for the flow of air between neighboring channels, each of said apertured ribs including a plurality of sections and at least some of said sections being inclined with reference to the longitudinal direction of said top wall, said inclined sections having different inclinations with reference to the longitudinal direction of said top wall.

23. A grate bar, particularly for use in the grates of industrial furnaces, comprising an elongated top wall; a front wall extending substantially transversely of and downwardly from the region of one end of said top wall; a rear wall extending substantially transversely of and downwardly from the region of the other end of said top wall; a pair of elongated sidewalls extending longitudinally of and downwardly from said top wall, at least between said front and rear walls; a bottom wall spaced apart from said top wall and defining therewith, as well as with said sidewalls and said front and rear walls, an air heating chamber, said grate bar having at least one first opening in the region of said rear wall for admission of fresh air into, and one of said sidewalls having a second opening in the region of said front wall for evacuation of air from, said chamber, said one sidewall having an inwardly extending front portion which is adjacent to said front wall and defines said second opening, said bottom wall having a portion extending laterally outwardly of said front portion so as to intercept at least some solid particles which happen to descend in the furnace along the outer side of the front portion of said one sidewall, said bottom wall including a front portion nearer to and a rear portion more distant from said front wall, said front and rear portions of said bottom wall defining an additional opening; and a plurality of cooling ribs extending from said top wall downwardly into said chamber to exchange heat with air flowing from said first toward said second opening, said ribs dividing said chamber into a plurality of channels extending substantially longitudinally of said top wall, and a compartment adjacent to said front wall and communicating with said channels as well as with said second opening, said ribs including a first rib which is nearest to said one sidewall and is spaced apart from said bottom wall, said ribs further including a first group of at least two ribs nearer to said one sidewall and including said first rib, and a second group of at least two ribs nearer to the other of said sidewalls, the ribs of said first group being spaced from said bottom wall and the ribs of said second group contacting said bottom wall, at least some of said ribs having apertures whch establish paths for the flow of air between neighboring channels, each of said apertured ribs including a plurality of sections and at least some of said sections being inclined with reference to the longitudinal direction of said top wall, said inclined sections having different inclinations with reference to the longitudinal direction of said top wall.

* * * * *

UNITED STATES PATENT AND TRADEMARK OFFICE

CERTIFICATE OF CORRECTION

PATENT NO. : 4,672,947

DATED : June 16, 1987

INVENTOR(S) : Johannes J.E. Martin

It is certified that error appears in the above—identified patent and that said Letters Patent is hereby corrected as shown below:

In the Abstract

Line 6, change "rar" to --rear--.

In the Specification

Col. 8, Line 18, add a comma after "11".

In the Claims

Column 12, Claim 23, Line 30, change "whch" to --which--.

Signed and Sealed this

Fifth Day of January, 1988

*Attest:*

DONALD J. QUIGG

*Attesting Officer*

*Commissioner of Patents and Trademarks*